United States Patent [19]

Tanabe

[11] Patent Number: 5,030,545

[45] Date of Patent: Jul. 9, 1991

[54] METHOD OF FORMING IMAGES BY SILVER SALT DIFFUSION TRANSFER

[75] Inventor: Osami Tanabe, Kanagawa, Japan

[73] Assignee: Fuji Photo Film Co., Ltd., Kanagawa, Japan

[21] Appl. No.: 363,655

[22] Filed: Jun. 8, 1989

[30] Foreign Application Priority Data

Jun. 8, 1988 [JP] Japan ..... 63-140802

[51] Int. Cl.[5] ..... G03C 5/54

[52] U.S. Cl. ..... 430/247; 430/230; 430/231; 430/233; 430/248; 430/227

[58] Field of Search ..... 430/227, 230, 231, 233, 430/244, 247, 248, 229, 246

[56] References Cited

U.S. PATENT DOCUMENTS 3,681,072 8/1972 Debruyn ..... 430/231
3,853,557 12/1974 Fassbender ..... 430/231
3,874,944 4/1975 Weed ..... 430/231
4,803,146 2/1989 Inoue et al. ..... 430/233

*Primary Examiner*—Richard L. Schilling
*Attorney, Agent, or Firm*—Sughrue, Mion, Zinn, Macpeak & Seas

[57] ABSTRACT

A method of forming images by silver salt diffusion transfer in which a photosensitive element which contains an imagewise exposed photosensitive silver halide emulsion layer is developed in the presence of a silver halide solvent using an alkaline processing composition, wherein at least part of the unexposed silver halide of the emulsion layer is formed into a transferable silver complex salt, at least part of the transferable silver complex salt is transferred to an image receiving layer to yield an image in the image receiving layer, wherein non-photosensitive silver precipitation nuclei are included in the photosensitive element. It is possible to obtain images without metallic luster in a stable manner.

8 Claims, No Drawings

METHOD OF FORMING IMAGES BY SILVER SALT DIFFUSION TRANSFER

FIELD OF THE INVENTION

This invention concerns a method of forming images by silver salt diffusion transfer, and film units in which this method is used.

BACKGROUND OF THE INVENTION

Methods of image formation by diffusion transfer in which silver salts, such as silver halides, are used are well known. In practical terms, these methods involve, for example, processing an imagewise exposed photosensitive silver halide emulsion layer with an aqueous alkaline solution which contains a developing agent, a silver halide solvent and a film forming agent (a viscosity increasing agent), reducing the exposed silver halide grains to silver with the developing agent and converting the unexposed silver halide grains to a transferable silver salt with the silver halide solvent, allowing the silver complex salt to diffuse and transfer by imbibition into a layer which contains a silver precipitant (an image receiving layer) which is laminated with the aforementioned emulsion layer, and reducing the silver complex with a developing agent with the assistance of a silver precipitant, thereby forming a silver image.

In practice, a film unit comprising a photosensitive element in which a photosensitive silver halide layer is provided on a support, an image receiving element in which an image receiving layer which contains a silver precipitant is provided on a support and a processing element consisting of a rupturable container which contains a viscous aqueous alkaline solution which itself contains a developing agent, a silver halide solvent and a film forming agent is used. The emulsion layer of the photosensitive element is first imagewise exposed and then the photosensitive element and the image receiving elements are laminated together in such a way that the emulsion layer and the image receiving layer face each other and then passed between a pair of rollers in such a way that the processing element which is between the elements is ruptured and the viscous aqueous alkaline solution is spread therebetween. After a prescribed period of time, the image receiving element is peeled away from the photosensitive element and a print consisting of the desired image formed in the image receiving layer is obtained.

However, no method has yet been discovered for achieving a higher transfer image forming rate with such photosensitive elements or for preventing the image which is formed from taking on a metallic luster.

SUMMARY OF THE INVENTION

An object of the present invention is to provide a novel method of image formation using silver salt diffusion transfer.

A further object of the present invention is to provide a method of silver salt diffusion transfer with a higher transfer image formation rate and wherein images without metallic luster are formed.

These objects of the invention have been realized by means of a method of forming images by silver salt diffusion transfer in which a photosensitive element which comprises an imagewise exposed photosensitive silver halide emulsion layer is developed in the presence of a silver halide solvent using an alkaline processing composition, in which at least part of the unexposed silver halide of the emulsion layer is formed into a transferable silver complex salt, in which at least part of the complex salt is transferred to an image receiving layer which contains a silver precipitant and in which an image is formed in the image receiving layer where non-photosensitive silver precipitation nuclei are included in the photosensitive element.

DESCRIPTION OF PREFERRED EMBODIMENTS

Preferably, image formation is achieved by means of a photosensitive element in which the aforementioned photosensitive silver halide emulsion comprises silver iodobromide or silver chloroiodobromide where the silver iodide content is at least 1.0 mol % but not more than 7.0 mol %.

With silver salt diffusion transfer processes it is desirable that images should be formed in a stable manner with as wide as possible a range of transfer processing time under a wide range of use temperatures.

Image densities are low with low temperature short processing transfers, and although high image densities are obtained with high temperature long processing transfers, the image is liable to take on a metallic luster and there is a marked loss of picture quality in terms of the photographic image.

Conventionally, a processing liquid which provided a high rate of development and dissolution was selected, or a silver halide which had a high development rate and a high dissolution rate was selected, or the coated weight of silver was increased and the film thickness was reduced, or combinations of these techniques were used, in order to increase the image formation rate with a low temperature short time processing, but with these techniques excess silver was precipitated near the surface of the image receiving layer when the materials were processed at high temperature over long periods of time and images with metallic luster were formed, which was undesirable. Hence, it was difficult to obtain the required images in a stable manner over a wide range of temperatures and times.

As a result of the investigation of various non-photosensitive additives it was found, surprisingly, that the inclusion of a few non-photosensitive silver precipitation nuclei in the photosensitive element did not retard the image formation rate at low temperatures with short processing times and that it did effectively avoid a metallic luster at high temperatures with long processing times.

Heavy metals, for examples, iron, lead, zinc, nickel, cadmium, tin, chromium, copper and cobalt, and especially the precious metals, for example, gold, silver (including fine colloidal silver), platinum and palladium are examples of the non-photosensitive silver precipitation nuclei of this invention. Other useful silver precipitants include sulfides and selenides of heavy metals and noble metals, and especially the sulfides of mercury, copper, aluminum, zinc, cadmium, cobalt, nickel, silver, lead, antimony, bismuth, cerium, magnesium, gold, platinum and palladium and the selenides of lead, zinc, antimony and nickel. Furthermore, prefogged silver halide grains are reduced by development and can, as metallic silver, form silver precipitation nuclei. Mixtures can also be used.

The non-photosensitive silver precipitation nuclei may be included in any of the layers of the photosensitive element, but they are preferably included in a layer other than the photosensitive silver halide emulsion layer and, most desirably, they are included in a layer which is closer to the support than any photosensitive silver halide emulsion layer. For example, photosensitive elements in which a non-photosensitive silver precipitation nuclei containing layer is provided on the support and in which a photosensitive silver halide emulsion layer (which may take the form of a plurality of layers) is subsequently provided are most desirable.

The preferred average particle size of the non-photosensitive silver precipitation nuclei is not more than 300 nm, and a size of from 5 to 60 nm is most desirable. A preferred coated weight of the nuclei is from 0.005 to 0.20 g/m$^2$, and from 0.015 to 0.10 g/m$^2$ is most desirable. Furthermore, the preferred weight ratio of the binder to the precipitation nuclei in the non-photosensitive silver precipitation nuclei containing layer is from 3 to 200, and most desirably from 10 to 100.

Various anti-fogging agents or stabilizers can be added to the non-photosensitive silver precipitation nuclei containing layer with a view to stabilizing photographic performance.

Developing agents can be included in the photosensitive elements or processing composition elements in the image formation method and film units of this invention. The developing agent is preferably included in a processing composition. Hydroquinone, tert-butylhydroquinone and benzene or naphthalene-based organic compounds which have hydroxyl groups in the para- or ortho-positions can be used, for example, as such developing agents.

Moreover, the use of reductic acids disclosed in U.S. Pat. No. 3,615,440 and $\alpha,\beta$-enediols disclosed in U.S. Pat. No. 3,730,716 is preferred. Moreover, the use of hydroxylamine developing agents those disclosed in U.S. Pat. Nos. 3,287,125 and 3,293,034 is especially desirable.

The amount of developing agent used is preferably from 0.1 to 40 grams, and most desirably from 1 to 20 grams, per 100 grams of processing composition.

Furthermore, alkyl substituted p-aminophenols and 1-aryl-3-pyrazolidone compounds disclosed in JP-B-49-13580 can be jointly used with the developing agents described above. (The term "JP-B" as used herein signifies an "examined Japanese patent publication".)

Silver halide solvents can be included in the processing composition element, the photosensitive element and/or the image receiving layer containing element. They are preferably included in the processing composition element. The cyclic compounds disclosed in U.S. Pat. Nos. 2,857,274, 2,857,275 and 2,857,276 are suitable for this purpose, and preferred examples from among these compounds include uracil, urazole and 6-methyluracil.

Moreover, the silver halide solvents can be selected from among the alkali metal thiosulfates, especially the sodium and potassium salts, the disulfoylmethane compounds disclosed in U.S. Pat. Nos. 3,958,992, 3,976,647, 4,009,167, 4,032,538, 4,046,568, 4,047,954, 4,047,955 and 4,107,176 and JP-A-47-330, the hydroxypyrimidine compounds which have thioether groups disclosed in U.S. Pat. Nos. 4,126,459, 4,150,228, 4,211,559 and 4,211,562, and the aminothioether compounds disclosed in U.S. Pat. Nos. 4,251,617, 4,267,254 and 4,267,265. These may be used individually or combinations can be used, and the joint use of two or more cyclic imido compounds and dihydroxypyrimidine compounds which have thioether groups is advantageous in that even when the prints are stored for long periods of time no white crystals precipitate out on the surface of the prints. (The term "JP-A" as used herein signifies an "unexamined published Japanese patent application".)

The amount of silver halide solvent added is preferably from 0.1 to 30 grams, and most desirably from 0.5 to 10 grams, per 100 grams of alkaline processing composition.

The processing liquid preferably contains a polymer film forming agent, a thickening agent or a viscosity increasing agent in cases where, in this invention, it is applied by distribution as a thin layer between a laminated photosensitive element and an image receiving element. Hydroxyethylcellulose and sodium carboxymethylcellulose are especially useful for this purpose, and they are included in the processing liquid at a concentration effective for providing an appropriate viscosity according to the known principles of the diffusion transfer photographic method. Other auxiliary agents, for example anti-fogging agents, toning agents and stabilizers etc., well known in the silver salt diffusion transfer method, may also be included in the processing liquid. The inclusion of hydroxyethylamino compounds, such as triethanolamine, is especially useful for increasing the storage life of the processing liquid, disclosed in U.S. Pat. No. 3,619,185.

Processing liquids of the type described above are preferably contained in a rupturable container to form a processing element. Any of the known rupturable containers and materials therefor can be used, and examples have been disclosed in detail, for example, in U.S. Pat. Nos. 3,056,491, 3,056,492, 3,173,580, 3,750,907, 3,833,381, 4,303,750 and 4,303,751.

The image receiving element in this invention is coated on a support, for example, a baryta paper, cellulose triacetate or polyester support, and includes an image receiving layer which contains a silver precipitant. Such an image receiving element is preferably obtained by covering a support, on which an underlayer has been provided, as required, with a covering solution of an appropriate cellulose ester, for example cellulose diacetate, in which a silver precipitant has been dispersed. The cellulose ester layer so obtained is subjected to alkali hydrolysis and at least part of the depth of the cellulose ester is converted to cellulose (saponification). In a particularly useful embodiment, the silver precipitant layer and (or) the lower part of the cellulose ester, for example cellulose diacetate, which has not been hydrolyzed contains one or more types of mercapto compounds which are suitable for improving the tone, stability or other photographic properties of the transferred silver image. Mercapto compounds of this type are used by diffusion from their initial position during imbibition. Image receiving elements of this type are disclosed in U.S. Pat. No. 3,607,269.

Further, image receiving elements in which a neutralizing acidic polymer layer (neutralizing layer) is provided between the unsaponified layer (timing layer) and the support are preferred.

Polymeric acids such as those disclosed, for example, in JP-B-48-33697, can be used in the alkali neutralizing layers which are used in the invention. The preferred polymeric acids include maleic anhydride copolymers, for example styrene/maleic anhydride copolymers, methyl vinyl ether/maleic anhydride copolymers and ethylene/maleic anhydride copolymers, and (meth)acrylic acid (co)polymers, for example acrylic acid/alkyl acrylate copolymers, acrylic acid/alkyl methacrylate copolymers, methacrylic acid/alkyl acrylate copolymers, and methacrylic acid/alkyl methacrylate copolymers.

Saulfonated polystyrene and other polymers which have sulfonic acid groups, such as acetal products from benzaldehydesulfonic acid and poly(vinyl alcohol) can also be used for this purpose. Further, the mercapto compounds used in the timing layer can also be included in the neutralizing layer. Also, mixtures of hydrolyzable alkali impermeable polymers (the aforementioned cellulose esters are preferred) or alkali permeable polymers such as poly(vinyl alcohol) can be used in the form of mixtures with these polymeric acids in order to improve film properties.

The compounds disclosed in JP-B-44418, JP-A-49-120634, British Patent 1,276,961, JP-B-56-21140, JP-A-59-231537 and JP-A-60-122939 are preferred as the mercapto compounds.

The presence of an image stabilizing layer in the image receiving element is desirable for improving the image storage properties, and polymeric cation electrolytes are preferred as such stabilizers. Thus, the use of the aqueous dispersion latexes disclosed in JP-A-59-166940, U.S. Pat. No. 3,958,995, JP-A-55-142339, JP-A-54-126027, JP-A-54-155835, JP-A-53-30328 and JP-A-54-92274, the polyvinylpyridinium salts disclosed in U.S. Pat. Nos. 2,548,564, 3,148,061 and 3,756,814, the water soluble quaternary ammonium salt polymers disclosed in U.S. Pat. No. 3,709,690, and the water insoluble quaternary ammonium salt polymers disclosed in U.S. Pat. No. 3,898,088 is most desirable for this purpose.

Further, cellulose acetate is preferred as the binder for the image stabilizing layer, and the use of a cellulose acetate where the degree of acetylation is from 40 to 49% is especially desirable.

The image stabilizing layer may be provided between the aforementioned neutralizing and timing layers.

Heavy metals, such as iron, zinc, nickel, cadmium, tin, chromium, copper, cobalt, and especially the precious metal, such as gold, silver, platinum and palladium, are examples of silver precipitants which can be used in the image receiving element. Sulfides and selenides of heavy metals and noble metals, especially the sulfides of mercury, copper, aluminum, zinc, cadmium, cobalt, nickel, silver, lead, antimony, bismuth, cerium, magnesium, gold, platinum and palladium, and the selenides of lead, zinc, antimony and nickel, are also useful silver precipitants.

The use of gold, platinum, palladium and their sulfides is especially desirable.

The amounts of silver precipitant and binder in the image receiving layer differ according to their type in each case, but when palladium sulfide (about 30 Å) and cellulose acetate are used, then the silver precipitation nuclei are preferably included in an amount of from $1\times10^{-4}$ to $5\times10^{-3}$ g/m$^2$, the binder is preferably used in an amount of from 1.0 to 5.0 g/m$^2$, and the silver precipitation nuclei/binder ratio preferably is from $1\times10^{-4}$ to $1\times10^{-2}$. The average particle size of the silver precipitation nuclei in the image receiving layer is preferably not more than 300 nm, and most desirably not more than 5 nm.

In order to prevent the formation of uneven images a hydrophilic polymer layer can be provided between the silver precipitation layer and the timing layer. Hydrophilic polymer layers as used in this invention are polymer layers which dissolve in water, and they may be, for example, polyacrylamide, gum arabic, poly(vinyl alcohol) and gelatin layers.

Further, a peeling layer may be provided on the surface of the image receiving layer to prevent the attachment of processing liquid to the surface of the image receiving layer on peeling apart after spreading the processing liquid. The preferred materials for such a peeling layer include gum arabic, hydroxyethylcellulose, methylcellulose, poly(vinyl alcohol), polyacrylamide and sodium alginate as well as the materials disclosed in U.S. Pat. Nos. 3,772,024 and 3,820,999, and British Patent 1,360,653.

The use of photosensitive elements obtained by coating a photosensitive silver halide emulsion onto a support is preferred in this invention.

Silver bromide, silver iodobromide, silver iodochlorobromide, silver chlorobromide or silver chloride can be used as the silver halide in the photosensitive silver halide emulsion used in the invention. The use of silver iodobromide or silver iodochlorobromide where the silver iodide content is not more than 10 mol % is preferred, and the use of silver iodobromide and silver chloroiodobromide which have a silver iodide content of from 1 mol % to 7.0 mol % is especially desirable.

No limitation is imposed on the average grain size of the silver halide grains present in the photosensitive emulsion (in the case of a spherical or almost spherical grains the grain size is the diameter of the sphere, and in the case of cubic grains the grain edge length is taken as the grain size, and the average grain size is expressed in terms of the projected areas), but the use of grains of an average size not more than 3$\mu$ is preferred, and the use of grains of an average size not more than 1.7$\mu$ is more desirable. The use of grains of an average grain size from 0.2 to 1.4$\mu$ is especially desirable.

The silver halide grains in the photosensitive emulsion may have crystalline form of an isometric system such as a cubic or octahedral form, an allotromorphic crystalline form such as a spherical or tabular form, or they may have a complex form including these crystalline forms. Use can also be made of mixtures of grains which have various crystalline forms.

The silver halide grains may have a structure in which the interior and the surface parts consist of different phases, or they may consist of a uniform phase. Furthermore the grains may be of the type where the latent image is formed principally on the surface of the grains, or the type where the latent image is formed principally within the grains. The use of the grains where the latent image is formed principally on the surface of the grains is preferred.

The thickness of the photosensitive emulsion layer is generally from 0.5 to 8.0$\mu$, and preferably from 0.6 to 6.0$\mu$ and the coated weight of silver halide grains is generally from 0.1 to 3 g/m$^2$, and preferably from 0.2 to 1.5 g/m$^2$.

The photosensitive emulsions can be prepared using the methods conventionally used for silver halide photographic emulsions, and conventional chemical sensitization and spectral sensitization can be carried out, as required. Moreover, anti-foggants, stabilizers, film hardening agents, coating aids and antistatic agents, for example, can also be included in the photosensitive emulsion(s). A conventional vehicle such as gelatin, for example, is generally used in the emulsion as a binder.

Exposure for obtaining the photographic image can be done using conventional methods. Thus the exposure can be done using any of the various known light sources, such as natural light (daylight), tungsten lamps, fluorescent lamps, mercury lamps, xenon arc lamps, carbon arc lamps, xenon flash lamps, cathode ray tube flying spots, etc. The exposure time may be from 1/1000th of a second to 1 second, i.e., as is normally used in cameras, of course, but exposures of less than 1/1000th of a second, for example exposures of from $10^{-4}$ to $10^{-6}$ second using xenon flash lamps or cathode ray tubes, and exposures in excess of 1 second, can also be used. The spectral composition of the light used for the exposure can be adjusted, as required, using filters. Exposure can also be done using laser light. Furthermore, exposure can also be done using the light emitted from phosphors which have been excited with electron beams, X-rays, $\gamma$-rays or $\alpha$-rays, for example.

Arrangement of the elements and bonding methods for making combinations of photosensitive elements, light receiving elements and processing elements as described above into film units is described, for example, by Neblette in the "Hand Book of Photography and Reprography", 7th edition, pages 282–285, and a particularly preferred embodiment is described in detail in U.S. Pat. No. 3,350,991. Reference should be made to the above literature in this connection.

The present invention can also be used in diffusion transfer methods where images are formed using an automatic developing machine.

Moreover, the invention can be applied not only to the type of units in which the photosensitive element is peeled away from the image receiving element after spreading the processing composition but also to integrally formed film units.

Thus, by means of this invention it is possible to obtain images in a stable manner which have the required image density with a silver salt transfer method under a wide range of temperatures and times for the transfer conditions without the generation of a metallic luster.

Examples and comparative examples are given below to provide a more detailed description of the invention.

EXAMPLE 1

1. PREPARATION OF THE IMAGE RECEIVING SHEET

The following layers were sequentially provided on a polyethylene laminated paper support to provide image receiving sheet (1).

1) Neutralizing Layer

Cellulose acetate (55% acetylated) (6 g/m$^2$), methyl vinyl ether/maleic anhydride copolymer (4 g/m$^2$), "Uvitex OB" (trade name, made by Ciba Geigy) (0.04 g/m$^2$), and 1-4(4-hexylcarbamoylphenyl)-2,3-dihydroimidazole-2-thione (0.25 g/m$^2$).

2) Image Stabilizing Layer

Cellulose acetate (46% acetylated) (4 g/m$^2$), and of the compound indicated below (2 g/m$^2$):

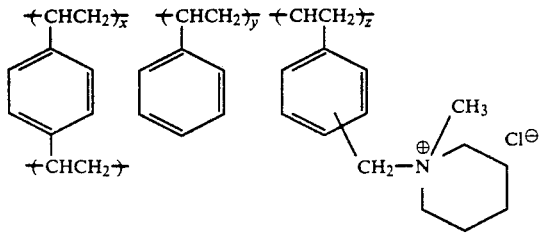

x:y:z=5:47.5:47.5 (by mol)

3) Timing Layer

Cellulose acetate (55% acetylated)

4) Image Receiving Layer

Cellulose acetate (55% acetylated) (2.0 g/m$^2$), palladium sulfide ($7.5\times10^{-4}$ g/m$^2$), 2-mercaptobenzimidazole ($4\times10^{-3}$ g/m$^2$) and 1-4-hexylcarbamoylphenyl)-2,3-dihydroindazole-2-thione ($1.0\times10^{-2}$ g/m$^2$).

5) Saponification

Image receiving sheet (1) was saponified from the surface with a liquid mixture of 10.7 grams of sodium hydroxide, 24 grams of glycerin and 280 ml of methanol.

6) Peeling Layer

Butyl methacrylate/acrylic acid copolymer (mol ratio 15:85), (0.04 g/m$^2$).

2. PREPARATION OF THE PHOTOSENSITIVE SHEET

The following layers were sequentially established on a support (a black polyester film). The numerical values indicate the coated weights in units of g/m$^2$. The amount shown in the case of colloidal silver or silver halide is the amount after calculation as silver. Further, the average grain size of the silver halide grains used are indicated in units of $\mu$.

| | |
|---|---|
| First Layer (Non-photosensitive Silver Precipitation Nuclei) | |
| Colloidal silver (0.01$\mu$) | 0.04 |
| Gelatin | 1.90 |
| Second Layer (Photosensitive Layer) | |
| Silver iodobromide emulsion (5.5 mol % silver iodide, 1.1$\mu$, tabular) | 0.15 |
| Gelatin | 0.50 |
| Third Layer | |
| Silver iodobromide emulsion (4.0 mol % silver iodide, 0.7$\mu$, spherical) | 0.20 |
| Silver iodobromide emulsion (2.5 mol %) silver iodide, 0.3$\mu$, spherical) | 0.30 |
| Gelatin | 2.40 |
| Fourth Layer (Protective Layer) | |
| Polymethyl methacrylate grains (3.0$\mu$) | 0.10 |
| Carbon black | 0.02 |
| Gelatin | 1.0 |

The above combination of silver iodobromide emulsions in the second and third layers provided Emulsion Layer A.

The combination of silver iodobromide emulsions in the second and third layers indicated below in an element prepared in the same way as before provided emulsion B.

| | |
|---|---|
| Second Layer | |
| Silver iodobromide emulsion (7.5 mol % silver iodide, 1.1$\mu$, tabular) | 0.15 |
| Third Layer | |
| Silver iodobromide emulsion (8.0 mol % silver iodide, 0.7$\mu$, spherical) | 0.20 |
| Silver iodobromide emulsion (9.0 mol % silver iodide, 0.3$\mu$, spherical) | 0.30 |
| Preparation of the Processing Liquid | |
| Titanium dioxide | 5 grams |
| Potassium hydroxide | 280 grams |
| Uracil | 90 grams |
| Tetrahydropyrimidinethione | 0.2 gram |
| 1-Phenyl-2-mercaptoimidazole | 0.2 gram |
| 2,4-dimercaptopyrimidine | 0.2 gram |
| Zinc oxide | 10 grams |

-continued

| | |
|---|---|
| Triethanolamine | 60 grams |
| Hydroxyethylcellulose | 45 grams |
| N,N-Bis-methoxyethylhydroxylamine (17% aqueous solution) | 260 grams |
| Water | 1250 ml |

4. SPREADING AND PROCESSING

Three sheets of each sample were exposed, processed immediately at 25° C. for a) 20 seconds, b) 30 seconds and c) 5 minutes and then peeled apart.

Samples 1 to 10 were prepared, as shown in Table 1, with the combination of photosensitive silver iodobromide emulsions in the second and third layers with a first layer of the photosensitive sheet which contained non-photosensitive silver precipitation nuclei in Examples 1 to 8 and with a first layer of the photosensitive sheet which did not contain the said silver precipitation nuclei in Comparative Examples 9 and 10.

It is clear from the results shown in Table 1 that the samples which contained non-photosensitive silver precipitation nuclei in the first layer provided images of about the same maximum density as the Comparative Examples while providing good image quality with no metallic luster at all.

TABLE 1

| Sample No. | Silver Precipitation Nuclei Type | Amount | Emulsion Type | Maximum Density 20 sec. | 30 sec. | Image Quality Presence of Metallic Luster after 5 min. processing | |
|---|---|---|---|---|---|---|---|
| 1 | Colloidal Silver | 0.04 | A | 1.88 | 1.91 | None | Invention |
| 2 | " | 0.08 | A | 1.84 | 1.89 | None | Invention |
| 3 | " | 0.04 | B | 1.68 | 1.88 | None | Invention |
| 4 | " | 0.08 | B | 1.65 | 1.86 | None | Invention |
| 5 | AgBrI Prefogged by Exposure (0.05μ) | 0.04 | A | 1.86 | 1.92 | None | Invention |
| 6 | AgBrI Prefogged by Exposure (0.05μ) | 0.08 | A | 1.83 | 1.90 | None | Invention |
| 7 | AgBrI Prefogged by Exposure (0.05μ) | 0.04 | B | 1.69 | 1.89 | None | Invention |
| 8 | AgBrI Prefogged by Exposure (0.05μ) | 0.08 | B | 1.62 | 1.87 | None | Invention |
| 9 | None | — | A | 1.85 | 1.90 | Strong | Comparison |
| 10 | None | — | B | 1.70 | 1.90 | Weak | Comparison |

While the invention has been described in detail and with reference to specific embodiments thereof, it will be apparent to one skilled in the art that various changes and modifications can be made therein without departing from the spirit and scope thereof.

What is claimed is:

1. A method of forming images by silver salt diffusion transfer in which a photosensitive element which contains an imagewise exposed photosensitive silver halide emulsion layer is developed in the presence of a silver halide solvent using an alkaline processing composition, wherein at least part of the unexposed silver halide of the emulsion layer is formed into a transferable silver complex salt, at least part of the transferable silver complex salt is transferred to an image receiving layer which contains a silver precipitant to yield an image in the image receiving layer and after image formation the image receiving layer is peeled away from the processing composition and the photosensitive element, wherein a non-photosensitive silver precipitation nuclei containing layer is provided as a layer closer to the support than any photosensitive silver halide emulsion layer; the non-photosensitive silver precipitation nuclei containing layer and the silver halide emulsion layer are adjacent to each other and contain gelatin as a binder; the silver precipitant in the image receiving layer is selected from the group consisting of gold, platinum, palladium, sulfides of mercury, copper, aluminum, zinc, cadmium, cobalt, nickel, silver, lead, antimony, bismuth, cerium, magnesium, gold, platinum or palladium and selenides of lead, zinc, antimony or nickel; and the non-photosensitive silver precipitation nuclei is at least one of colloidal silver and prefogged silver halide.

2. A method of forming images by silver salt diffusion transfer as claimed in claim 1, wherein the average particle size of the non-photosensitive silver precipitation nuclei is not more than 300 nm.

3. A method of forming images by silver salt diffusion transfer as claimed in claim 1, wherein the average particle size of the non-photosensitive silver precipitation nuclei is from 5 to 60 nm.

4. A method of forming images by silver salt diffusion transfer as claimed in claim 1, wherein the non-photosensitive silver precipitation nuclei are coated in an amount of from 0.015 to 0.10 g/m$^2$.

5. A method of forming images by silver salt diffusion transfer as claimed in claim 1, wherein the weight ratio of the binder to the non-photosensitive silver precipitation nuclei in the non-photosensitive silver precipitation nuclei-containing layer is from 3 to 200.

6. A method of forming images by silver salt diffusion transfer as claimed in claim 1, wherein the weight ratio of the binder to the non-photosensitive silver precipitation nuclei in the non-photosensitive silver precipitation nuclei-containing layer is from 10 to 100.

7. A method of forming images by silver salt diffusion transfer as claimed in claim 1, wherein the non-photosensitive silver precipitation nuclei are selected from the group consisting of iron, lead, zinc, nickel, cadmium, tin, chromium, copper, cobalt, gold, silver, platinum, and palladium.

8. A method of forming images by silver salt diffusion transfer as claimed in claim 1, wherein the non-photosensitive silver precipitation nuclei are pre-fogged silver halide grains.

* * * * *